US007318399B2

(12) United States Patent
Methley

(10) Patent No.: US 7,318,399 B2
(45) Date of Patent: Jan. 15, 2008

(54) VARIABLE VALVE MECHANISM

(75) Inventor: Ian Methley, Witney (GB)

(73) Assignee: Mechadyne PLC, Kirtlington, Oxford (GB)

( * ) Notice: Subject to any disclaimer, the term of this patent is extended or adjusted under 35 U.S.C. 154(b) by 0 days.

(21) Appl. No.: 11/529,955

(22) Filed: Sep. 29, 2006

(65) Prior Publication Data

US 2007/0074689 A1 Apr. 5, 2007

(30) Foreign Application Priority Data

Sep. 30, 2005 (GB) ..... 0519876.7

(51) Int. Cl.
*F01L 1/34* (2006.01)

(52) U.S. Cl. ..... 123/90.16; 123/90.31; 123/90.39

(58) Field of Classification Search ..... 123/90.16, 123/90.31, 90.39, 90.27, 90.15
See application file for complete search history.

(56) References Cited

U.S. PATENT DOCUMENTS 6,584,943 B1 * 7/2003 Klotz ..... 123/90.16

* cited by examiner

*Primary Examiner*—Zelalem Eshete
(74) *Attorney, Agent, or Firm*—Smith-Hill and Bedell

(57) ABSTRACT

A valve train comprises a poppet valve 18 actuated by two rotatable cams 30, 32 which can preferably be phase shifted relative to one another. A first rocker 39 is supported on a fixed rocker 40 shaft by way of an eccentric sleeve 42 that is rotatable relative to the rocker shaft 40. A second rocker 37 directly supported on the rocker shaft 40 acts to rotate the eccentric sleeve 42 about the rocker shaft 40. In this way, the first rocker 39, which is operated by a first cam 30 and acts on the poppet valve 18 has its axis of rotation displaced cyclically towards and away from the valve 18 by the action of the second cam 32 and the second rocker 37.

10 Claims, 5 Drawing Sheets

VARIABLE VALVE MECHANISM

FIELD OF THE INVENTION

The present invention relates to a valve train for use in an internal combustion engine that is capable of achieving variable lift and event duration.

BACKGROUND OF THE INVENTION

The closest prior art to the present invention is believed to be EP 1426569. This patent teaches how the action of two separate cam profiles can be combined by means of a summation rocker system to achieve variable lift and event duration. It is however a disadvantage of the latter patent that in order to avoid large twisting forces it is necessary to use three cams to operate each valve. A central cam having the first profile is arranged between two other cams having the second profile. This triplication results in an expensive and bulky design, especially in an engine that uses pushrods between the cams and the rockers.

OBJECT OF THE INVENTION

The present invention therefore seeks to provide a valve train that can allow the action of two cam profiles to be summed in order to achieve variable lift and event duration without the need to provide three cams.

SUMMARY OF THE INVENTION

According to the present invention, there is provided a valve train comprising a poppet valve actuated by two rotatable cams, a first rocker supported on a fixed rocker shaft by way of an eccentric sleeve that is rotatable relative to the rocker shaft and a second rocker directly supported on the rocker shaft, wherein the first rocker is operated by a first of the two cams and acts on the poppet valve and the second rocker is operated by the second of the two cams and acts to rotate the eccentric sleeve about the rocker shaft.

The action of the two cams is combined in the present invention by cyclically moving the pivotal axis of the first rocker towards and away from the valve by the action of the second cam and the second rocker. When the eccentric sleeve, which is rotated by the second cam through the second rocker, moves the axis of the first rocker to its furthest point away from the valve, then the movement of the first rocker by the first cam has no effect on the valve. Also, when the first rocker is on the base circle of the first cam, no extent of rotation of the eccentric sleeve will result in the valve being opened. Consequently, the valve can only be opened when the two cams are acting in unison and by suitable phasing of the two cams it is possible to vary the event duration and the valve lift.

In the case of an engine having a pair of intake or exhaust valves, it is possible to provide a third cam and a third rocker to operate the second valve. In such an embodiment, the third cam acts on the second poppet valve by way of the third rocker and the third rocker is mounted on a second eccentric sleeve that is rotatable about the rocker shaft by the second rocker. It is possible to arrange for the two valves of a pair to have different event by forming the two eccentric sleeves with different eccentricities.

Any suitable method can be adopted to enable the cams to act on the rockers, the choice being determined by the architecture of the engine. In particular, one may use roller followers, pushrods or some combination of the two.

The cams operating the different rockers may be mounted for rotation about the same axis or they may be formed by cams on two separate camshafts.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
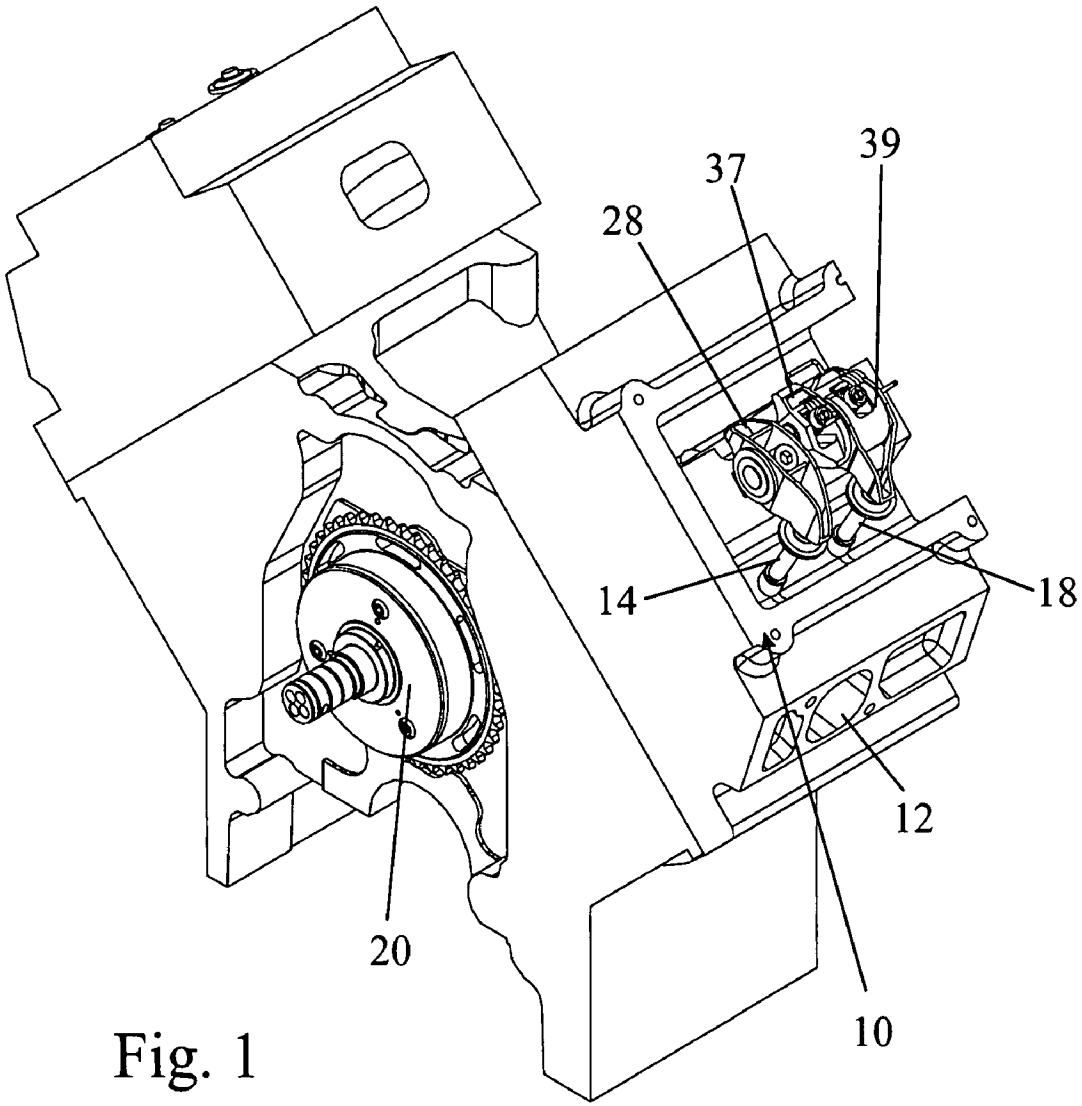
FIG. 1 is a perspective view from the front and above of a cylinder head fitted with a valve train of the present invention.

FIG. 1 shows a "V" engine having a cylinder head 10. The first cylinder of the right hand bank of cylinders has an exhaust port 12 controlled by an exhaust valve 14 operated by a rocker 28 and an intake port controlled by a poppet valve 18 operated by a mechanism that comprises two rockers 37 and 39. The rockers 28, 37 and 39 are operated by way of pushrods from cams on a camshaft mounted centrally between the two banks of cylinders and driven from the camshaft of the engine through a phase changing mechanism 20.

Figure 2:
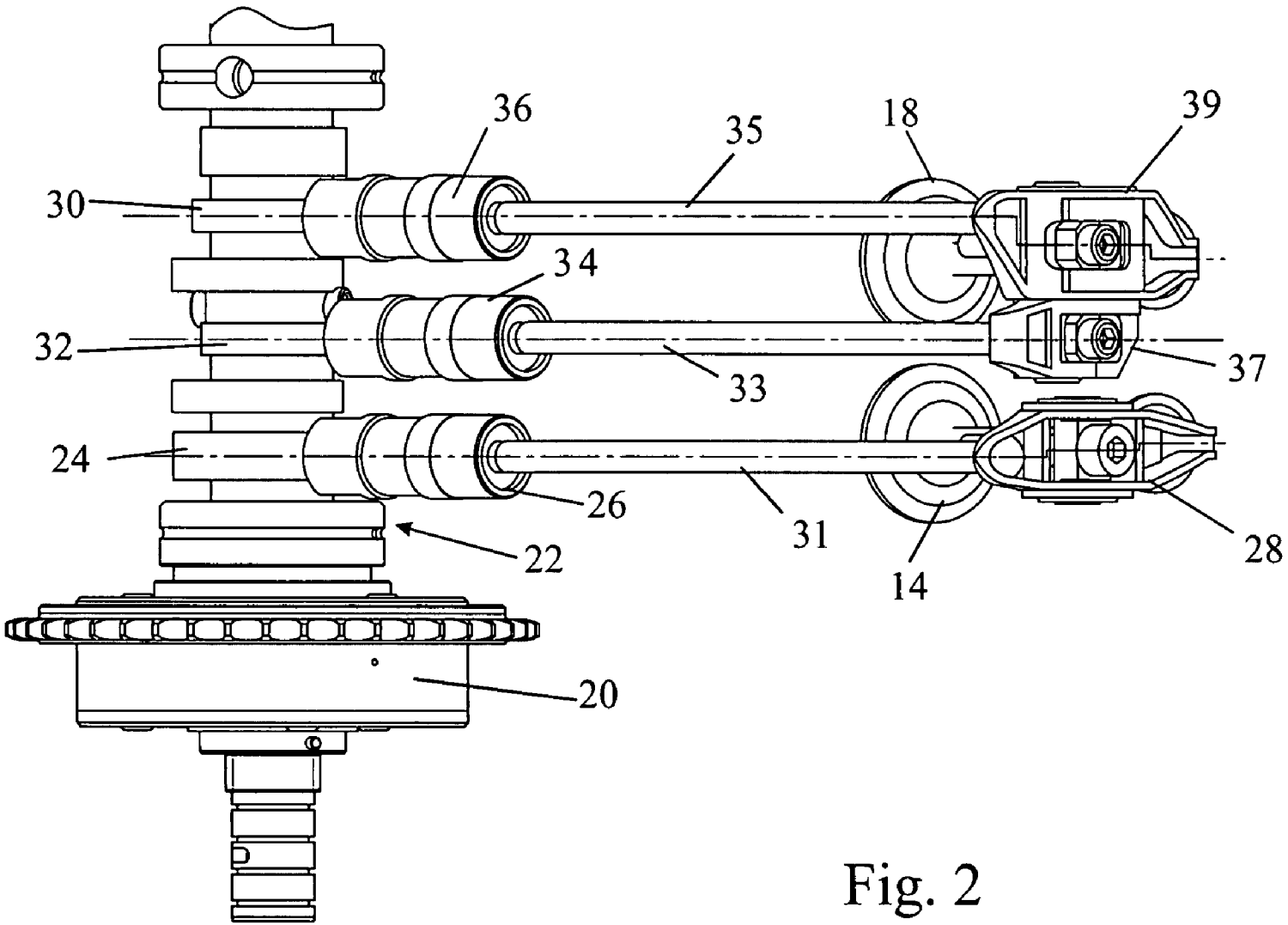
FIG. 2 is a top view of the valve train with the cylinder head and cylinder block omitted in the interest of clarity.
Figure 4:
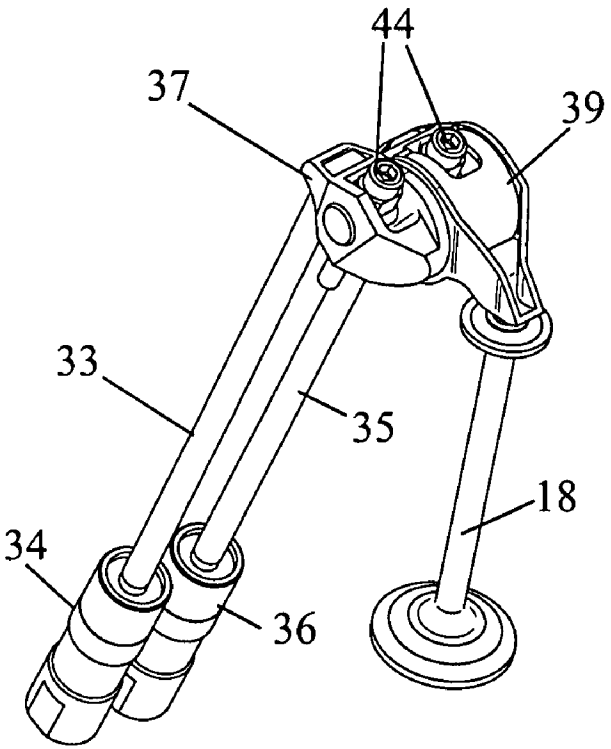
FIGS. 3 and 4 are respectively exploded and assembled views of the valve train shown in FIG. 2, FIGS. 5A to 5D show isometric views from different angles of a valve train of the invention designed for use in an engine with a single overhead camshaft and having a single intake and a single exhaust valve for each cylinder.
Figure 3:
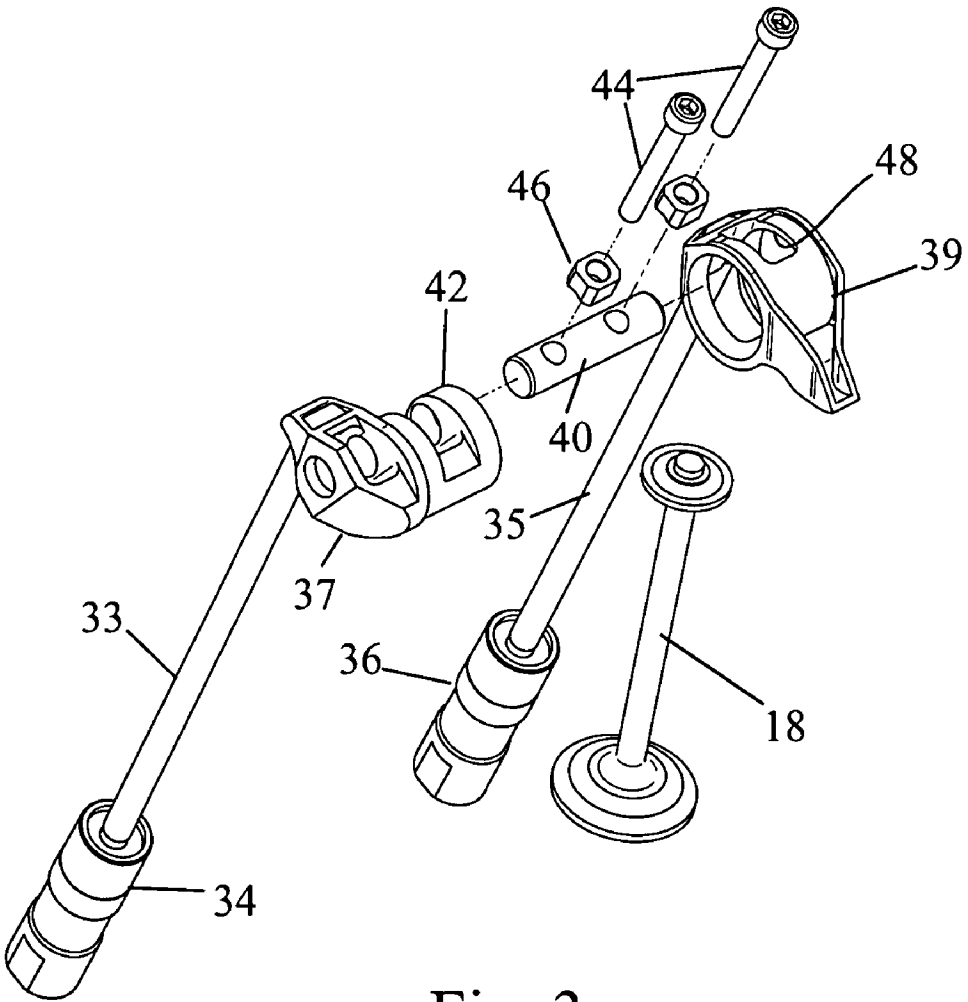
Figure 5B:
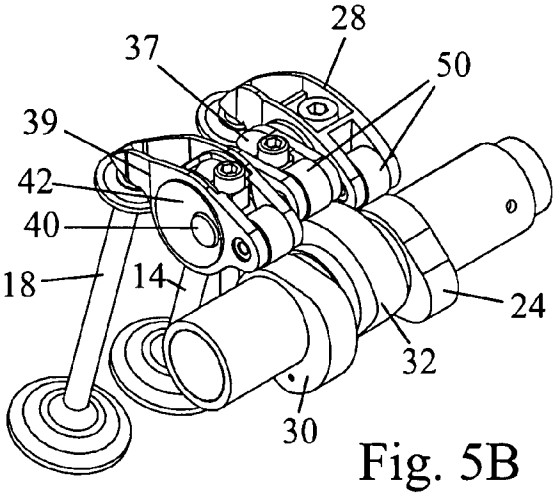
Figure 5D:
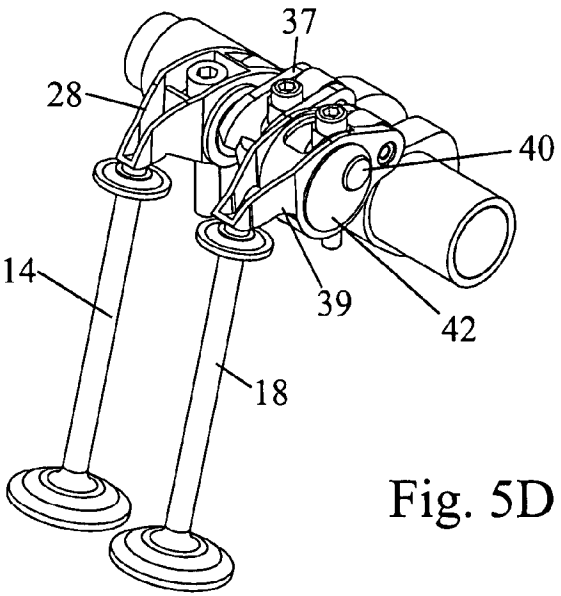
Figure 5A:
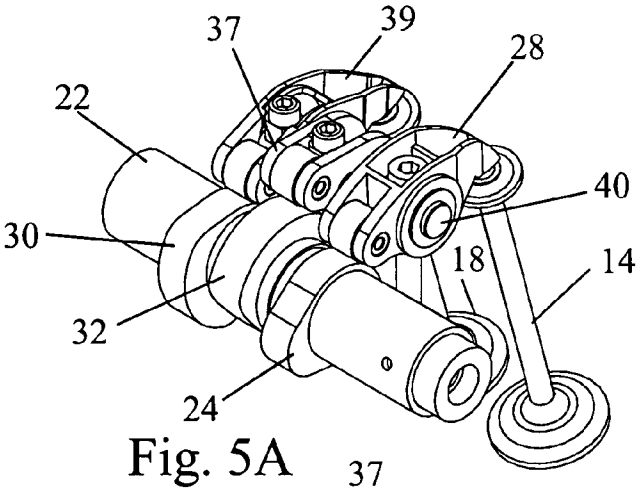
Figure 5C:
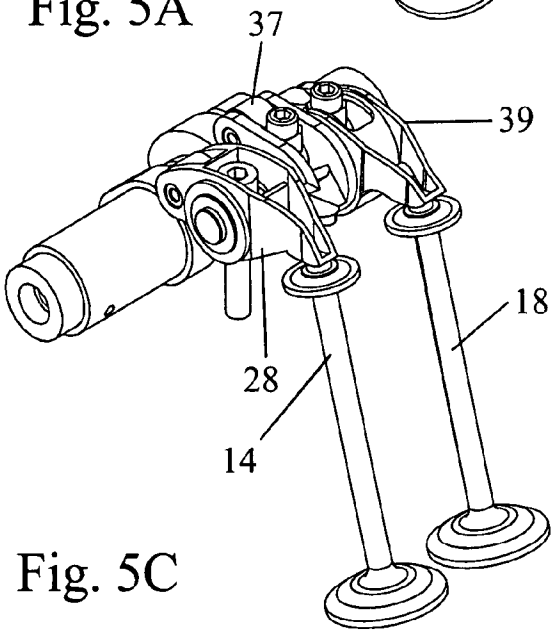
Figure 6A:
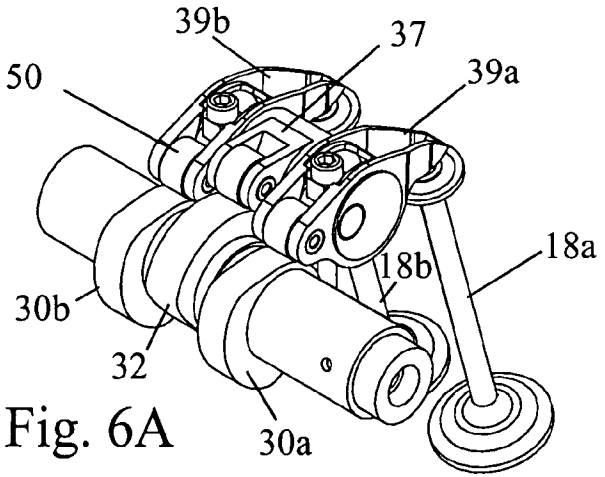
FIGS. 6A to 6D are isometric views from different angles of a valve train of the invention designed for use in an engine having two intake valves per cylinder.
Figure 6B:
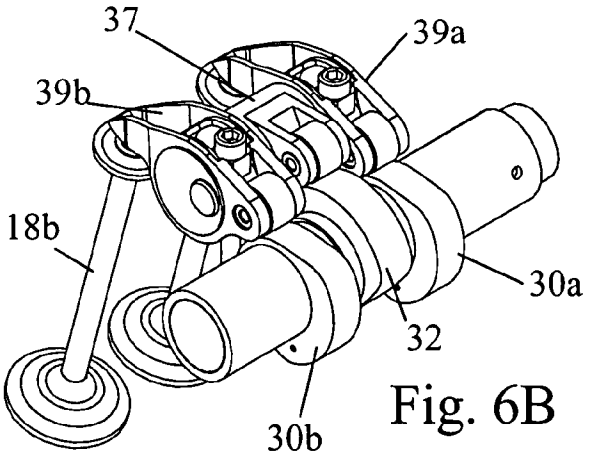
Figure 6C:
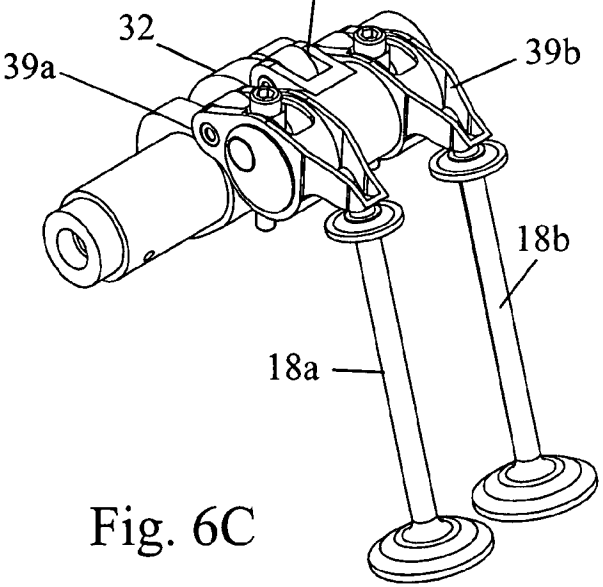
Figure 6D:
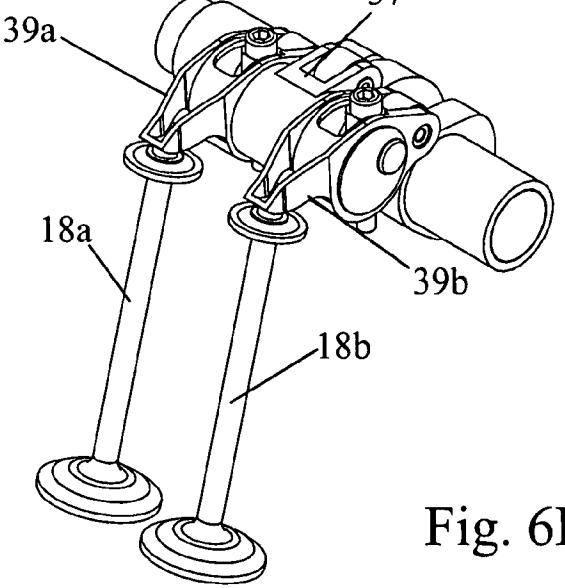

FIGS. 2 to 4 show the components of the valve train with the cylinder head removed. The phase changing mechanism 20 acts on an assembled camshaft 22 having cams 24, 32 and 30. The phase of the cam 32 can be varied relative to the cams 24 and 30 by means of the phase changing mechanism 20.

The cam 24 acts on the exhaust valve 14 through a conventional mechanism comprising a cam follower 26, a pushrod 31 and the rocker 28. The cams 30 and 32 on the other hand are both intended to operate the intake valve 18. The cam 32 acts by way of a cam follower 34 and a pushrod 33 on the rocker 37 which, as shown more clearly in the exploded view of FIG. 3, is mounted on a stationary rocker shaft 40 and has an axial extension in the form of an eccentric sleeve 42. It is not essential for the rocker 37 to be formed integrally with the eccentric sleeve 42 and they may instead be formed separately but provided with mating formations to ensure that they rotate in unison with one another. The cam 30 acts by way of a cam follower 36 and a pushrod 35 on the rocker 39 which actuates the intake valve 18, the rocker 39 being mounted for rotation about the eccentric sleeve 42.

Because of the number of rockers, space on the rocker shaft 40 to secure it to the cylinder head is at a premium. It may therefore prove necessary for some of the fixings of the rocker shaft 40 to pass through some of the rockers. As shown in FIG. 3, this may be accomplished by providing elongated slots 48 in the rockers to receive fixings. The fixings in the illustrated embodiment are bolts 44 which hold the rocker shaft 40 in place and apply a clamping force to the rocker shaft 40 through suitably shaped spacer blocks 46 having a flat top face and a part-cylindrical lower face.

The cam 32 acts through the rocker 37 to rotate the eccentric sleeve 42 relative to the stationary rocker shaft 40. This in turn moves the pivotal axis of the rocker 39 relative to the intake valve 18. If the rocker 39 is moved to its furthest point away from the valve, then its movement by the cam 30 has no effect on the valve 18. Also, if the cam follower 36 is on the base circle of the cam 30, no extent of rotation of the eccentric sleeve 42 will result in the valve 18 being opened. Consequently, the valve 18 can only be opened when the two cams act in unison. By suitable phasing of the two cams, it is possible to vary the event duration and the valve lift in a manner analogous to that described in EP 1426569.

When both the rockers 37 and 39 are following the base circles of their respective cams, there is a significant clearance between the stem of the valve 18 and the rocker 39. To ensure that the cam followers remain in contact with their associated cams, springs (not shown) are used to maintain the rockers and the pushrods in contact with one another.

The embodiment illustrated in FIGS. 5A to 5D operates in substantially the same manner as that previously described but is intended for use in an engine having a single overhead camshaft and a single intake and exhaust valve for each cylinder. To avoid unnecessary repetition, the same reference numerals have been allocated to components serving the same functions as previously described. Here, as previously, the camshaft has three cams 24, 32 and 30 operating two valves of which one is an exhaust valve 14 and the other an intake valve 18. The exhaust valve 14 is operated by a dedicated rocker 28 whereas the intake valve 18 is operated by the two rockers 37 and 39 acting jointly in the manner previously described. In place of the cam followers and pushrods of the previously described embodiment, each of the rockers 28, 37 and 39 has a roller cam follower 50 in direct contact with its associated cam.

The embodiment illustrated in FIGS. 6A to 6D once again uses three cams to operate two valves 18*a* and 18*b* but in this case the two valves are both intake valves. The cam and rocker used to operate the exhaust valve in this embodiment are not illustrated but are the same as previously described.

The rocker 37 serves the same function as previously described, namely to rotate an eccentric sleeve but in this case there are two eccentric sleeves arranged one on each side of the rocker 37. The two intake valves designated 18*a* and 18*b* are operated by two rockers 39*a* and 39*b* which are mounted for rotation about the respective eccentric sleeves and driven by cams 30*a* and 30*b*. In other words, the same structure as previously described is mirrored onto the other side of the rocker 37 to enable two valves to be operated. The two eccentric sleeves in this embodiment need not be identical and by varying the eccentricity of one sleeve in relation to the other it is possible to arrange for the two valves to have different events even if the cams 30*a* and 30*b* have the same profile.

It will be appreciated that in place of an assembled camshaft having cams rotatable about the same axis, it is possible to use cams arranged on separate camshafts that can be phased relative to one another. This is particularly relevant to push-rod engines where there is significant freedom regarding the position of the cam followers relative to the rockers.

The invention claimed is:

1. A valve train, comprising a poppet valve, two rotatable cams for actuating the poppet valve, a fixed rocker shaft, an eccentric sleeve rotatable relative to the rocker shaft, a first rocker rotatably supported by the eccentric sleeve on the rocker shaft, the first rocker being operated by a first of the two cams and acting on the poppet valve, and a second rocker directly supported on the rocker shaft and operated by a second of the two cams and acting to rotate the eccentric sleeve about the rocker shaft.

2. A valve train as claimed in claim 1, further comprising a second poppet valve, a second eccentric sleeve that is rotatable about the rocker shaft by the second rocker, a third rocker mounted on the second eccentric sleeve, and a third cam acting on the second poppet valve by way of the third rocker.

3. A valve train as claimed in claim 2, wherein the two eccentric sleeves have different eccentricities.

4. A valve train is claimed in claim 1, wherein the eccentric sleeve is formed integrally with the second rocker.

5. A valve train is claimed in claim 2, wherein each of the eccentric sleeves the is formed integrally with the second rocker.

6. A valve train is claimed in claim 1, wherein at least one of the rockers is provided with a cam follower in direct contact with the associated cam.

7. A valve train as claimed in claim 1, wherein a push rod and a cam follower are provided between at least one of the rockers and the associated cam.

8. A valve train is claimed in claim 1, wherein the cams are rotatable about the same axis as one another.

9. A valve train as claimed in claim 1, wherein the rocker shaft is secured to the engine by means of at least one fixing that passes a through circumferentially elongated slot in one of the rockers.

10. An engine comprising a poppet valve, two rotatable cams for actuating the poppet valve, a fixed rocker shaft, an eccentric sleeve rotatable relative to the rocker shaft, a first rocker rotatably supported by the eccentric sleeve on the rocker shaft, the first rocker being operated by a first of the two cams and acting on the poppet valve, a second rocker directly supported on the rocker shaft and operated by a second of the two cams and acting to rotate the eccentric sleeve about the rocker shaft, and a phase changing mechanism for varying the relative phase of rotation of the two cams.

* * * * *